US009059527B2

(12) United States Patent
Higuchi et al.

(10) Patent No.: US 9,059,527 B2
(45) Date of Patent: Jun. 16, 2015

(54) CONNECTOR

(75) Inventors: Koji Higuchi, Tokyo (JP); Yoshinori Mizusawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 82 days.

(21) Appl. No.: 13/995,256

(22) PCT Filed: Aug. 31, 2011

(86) PCT No.: PCT/JP2011/069708

§ 371 (c)(1),
(2), (4) Date: Jun. 18, 2013

(87) PCT Pub. No.: WO2012/086267

PCT Pub. Date: Jun. 28, 2012

(65) Prior Publication Data

US 2013/0288543 A1 Oct. 31, 2013

(30) Foreign Application Priority Data

Dec. 22, 2010 (JP) ..... 2010-286497

(51) Int. Cl.
*H01R 13/434* (2006.01)
*H01R 13/426* (2006.01)
(Continued)

(52) U.S. Cl.
CPC ..... *H01R 13/434* (2013.01); *H01R 13/426* (2013.01); *H01R 13/518* (2013.01); *H01R 13/748* (2013.01); *H01R 13/44* (2013.01); *H01R 13/447* (2013.01)

(58) Field of Classification Search
USPC ..... 439/357, 752
See application file for complete search history.

(56) References Cited

U.S. PATENT DOCUMENTS 4,193,655 A * 3/1980 Herrmann, Jr. ..... 439/166
5,362,261 A * 11/1994 Puerner ..... 439/752
(Continued)

FOREIGN PATENT DOCUMENTS

JP 62-264578 A 11/1987
JP 3-214574 9/1991
(Continued)

OTHER PUBLICATIONS

Taiwanese Office Action dated Dec. 27, 2013 in Taiwanese Application No. 100132031.
(Continued)

*Primary Examiner* — Truc Nguyen
(74) *Attorney, Agent, or Firm* — Collard & Roe, P.C.

(57) ABSTRACT

A connector comprises a housing, a power contact attached to the housing, and a fixing member fixing the power contact to the housing. The connector is mateable along a front-rear direction with a mating connector located at a mating side. The housing has a rear wall, a contact-holding hole and an abutment portion, wherein the contact-holding hole pierces the rear wall in the front-rear direction, and the abutment portion is located toward the mating side with respect to the contact-holding hole. The power contact has a held portion, a fixed portion and an abutting portion, wherein the held portion is inserted in the contact-holding hole from the mating side to be held by the contact-holding hole, the fixed portion is formed to be located far from the mating side with respect to the held portion, and the abutting portion is formed to be located toward the mating side with respect to the held portion so that the abutting portion is brought into abutment with the abutment portion when the held portion is inserted in the contact-holding hole. The fixing member is attached to the held portion so that a part of the housing is sandwiched between the abutting portion and the fixing member in the front-rear direction.

19 Claims, 9 Drawing Sheets

(51) Int. Cl.

| | |
|---|---|
| ***H01R 13/44*** | (2006.01) |
| *H01R 13/518* | (2006.01) |
| *H01R 13/74* | (2006.01) |
| *H01R 13/447* | (2006.01) |

(56) References Cited

U.S. PATENT DOCUMENTS

| | | | | |
|---|---|---|---|---|
| 6,113,436 | A | 9/2000 | Kuwahara et al. | |
| 6,773,304 | B2 * | 8/2004 | Conway et al. | 439/595 |
| 7,083,462 | B1 * | 8/2006 | Chen et al. | 439/372 |
| 7,108,514 | B2 * | 9/2006 | Chen et al. | 439/63 |
| 7,273,382 | B2 | 9/2007 | Igarashi et al. | |
| 7,909,668 | B2 * | 3/2011 | McAlonis et al. | 439/891 |
| 2003/0207607 | A1 * | 11/2003 | Matsumoto et al. | 439/357 |
| 2007/0232136 | A1 * | 10/2007 | Fryzek et al. | 439/578 |

FOREIGN PATENT DOCUMENTS

| | | | |
|---|---|---|---|
| JP | 5-072064 | U | 9/1993 |
| JP | 3010103 | U | 2/1995 |
| JP | 8-031489 | A | 2/1996 |
| JP | 8-315914 | A | 11/1996 |
| JP | 2000-003750 | A | 1/2000 |
| JP | 2002-093490 | A | 3/2002 |
| JP | 2003-308932 | A | 10/2003 |
| JP | 2006-228463 | A | 8/2006 |
| JP | 2006-244902 | A | 9/2006 |
| TW | M374684 | U1 | 2/2010 |

OTHER PUBLICATIONS

Korean Office Action dated Sep. 26, 2014 in Korean Application No. 10-2013-7017376.

International Search Report of PCT/JP2011/069708, date of mailing Oct. 25, 2011.

Chinese Office Action in CN 201180061534.X, issued Feb. 12, 2015.

* cited by examiner

CONNECTOR

CROSS REFERENCE TO RELATED APPLICATIONS

This application is the National Stage of PCT/JP2011/069708 filed on Aug. 31, 2011, which claims priority under 35 U.S.C. §119 of Japanese Application No. 2010-286497 filed on Dec. 22, 2010, the disclosure of which is incorporated by reference. The international application under PCT article 21(2) was not published in English.

TECHNICAL FIELD

This invention relates to a connector having a power contact for a large current flow. This invention, in particular, relates to a fixing structure for fixing the power contact to a housing.

BACKGROUND ART

For example, a fixing structure for fixing a contact to a housing is disclosed in Patent Document 1 or Patent Document 2.

As shown in FIG. 17, a connector of Patent Document 1 comprises a contact and a housing. The contact is press-fit into the housing from a front surface (mating surface) of the housing to be fixed to the housing.

As shown in FIG. 18, a connector of Patent Document 2 comprises a contact, a housing and a C-type retaining ring. The contact is inserted into the housing from a rear surface of the housing. The C-type retaining ring (fixing member) is inserted from a front surface (mating surface) of the housing to be attached around the contact so that the contact is fixed in the housing.

PRIOR ART DOCUMENTS

Patent Document(s)
Patent Document 1: JP A 2002-93490
Patent Document 2: JP A 2003-308932

SUMMARY OF INVENTION

Technical Problem

However, as for the connector described in Patent Document 1, the contact might not be stably fixed to the housing. Accordingly, if the contact of Patent Document 1 is used as a power contact, an electric current might not be stably supplied.

As for the connector of Patent Document 2, a large space is required around the contact for attaching a fixing member (for example, the C-type retaining ring) so that the contact has a large exposed portion. Accordingly, if the contact of Patent Document 2 is used as a power contact, a problem such as an electric shock might occur.

It is an object of the present invention to provide a connector comprising a power contact, wherein the contact is attached to a housing so as not to cause a problem such as an electric shock and to stably supply an electric current.

Solution to Problem

One aspect of the present invention provides a connector mateable along a front-rear direction with a mating connector located at a mating side. The connector comprises a housing, a power contact attached to the housing, and a fixing member fixing the power contact to the housing. The housing has a rear wall, a contact-holding hole and an abutment portion, wherein the contact-holding hole pierces the rear wall in the front-rear direction, and the abutment portion is located toward the mating side with respect to the contact-holding hole. The power contact has a held portion, a fixed portion and an abutting portion, wherein the held portion is inserted in the contact-holding hole from the mating side to be held by the contact-holding hole, the fixed portion is formed to be located far from the mating side in the front-rear direction with respect to the held portion, and the abutting portion is formed to be located toward the mating side with respect to the held portion so that the abutting portion is brought into abutment with the abutment portion when the held portion is inserted in the contact-holding hole. The fixing member is attached to the held portion so that a part of the housing is sandwiched between the abutting portion and the fixing member in the front-rear direction.

Advantageous Effects of Invention

According to the present invention, a rear wall of a housing is sandwiched by a fixing member and an abutting portion, wherein the fixing member is located at a rear surface side of the rear wall while the abutting portion is located at a front surface side of the rear wall, so that a power contact is fixed to the housing. Accordingly, a working space for attaching the fixing member may not be provided around the power contact. It is therefore possible to form a structure for preventing an electric shock with respect to a power contact.

Especially, if the abutting portion of the power contact has an angular column-like shape, the power contact is preventable from rotating when fixed to the housing.

An appreciation of the objectives of the present invention and a more complete understanding of its structure may be had by studying the following description of the preferred embodiment and by referring to the accompanying drawings.

DESCRIPTION OF EMBODIMENTS

Figure 1:
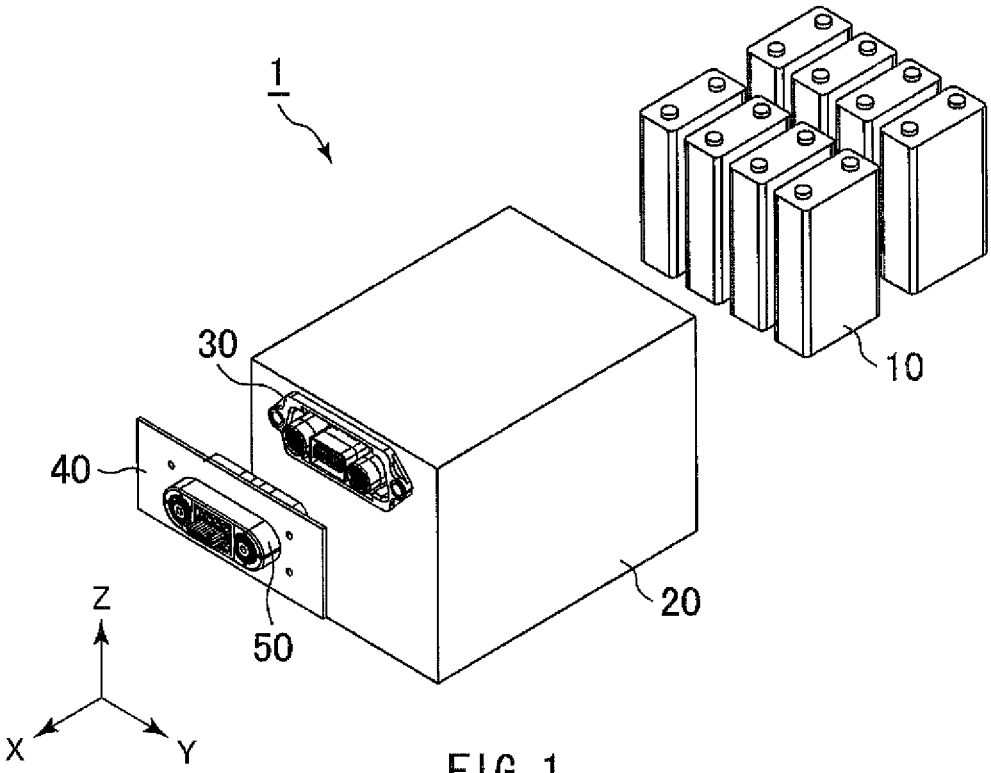
FIG. 1 is a perspective view roughly showing a system comprising a connector combination according to an embodiment of the present invention as an interlace for a storage battery module.
Figure 2:
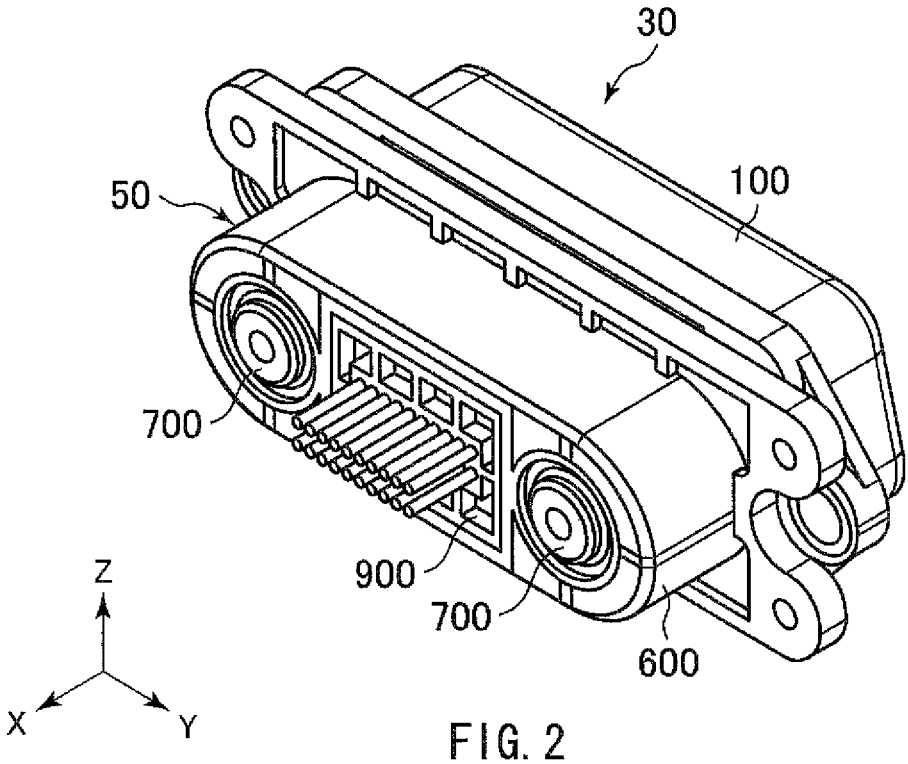
FIG. 2 is a perspective view showing the connector combination used in the system of FIG. 1.
Figure 3:
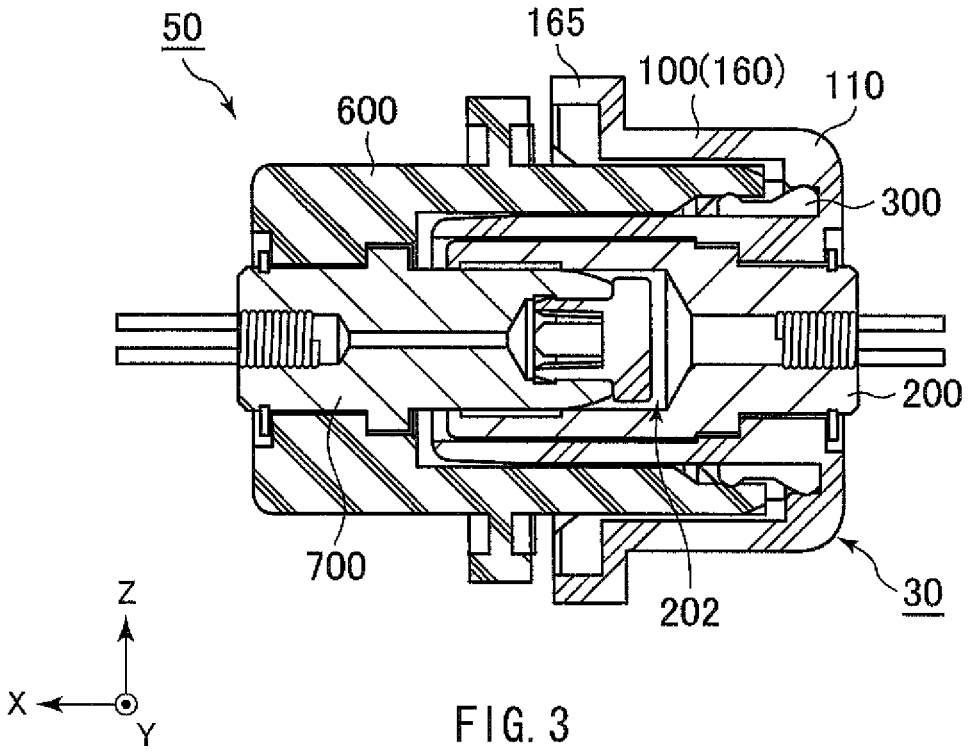
FIG. 3 is a cross-sectional view showing a power contact of the connector combination of FIG. 2 and the vicinity of the power contact.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Referring to FIG. 1, a connector combination according to an embodiment of the present invention is used in a system which includes a storage battery module 1. The connector combination comprises a receptacle (connector) 30 and a plug 50, wherein the receptacle 30 is attached to a module box 20 which accommodates a storage battery 10, and the plug (connector) 50 is attached to a panel 40. As described later, the receptacle 30 and the plug 50 comprise power contacts 200 and 700, respectively. Each of the power contacts 200 and 700 is used as a contact for large current flow of, for example, 100 A or more working current.

As can be seen from FIGS. 1 to 4, the receptacle 30 and the plug 50, which constitute the connector combination, are mateable with each other and removable from each other along the X-direction (front-rear direction). In the following description, a mating side, which is configured to be mated with the mating connector, of each of the receptacle 30 and the plug 50 is referred to as a front side while its opposite side is referred to as a rear side. Accordingly, as for the receptacle 30, the positive X-direction is directed forward while the negative X-direction is directed rearward. On the other hand, as for the plug 50, the negative X-direction is directed forward while the positive X-direction is directed rearward. Hereinafter, with reference to the drawings, detail explanations are made about the receptacle 30 and the plug 50, respectively.

As shown in FIGS. 5 to 8, the receptacle 30 according to the present embodiment comprises a housing 100 made of an insulating material, two of the power contacts (receptacle power contacts) 200 each made of a metal, two springs 250 each made of a metal, a sealing member 300 having a ring-like shape and made of an elastic member, C-type retaining rings (fixing members) 260 each made of a metal, and an intermediary connector (intermediary-connector-for-receptacle) 400. Each of the power contacts 200 is attached to the housing 100. The C-type retaining ring 260 fixes the power contact 200 to the housing 100. The receptacle 30 may comprise a metal ring (for example, an E-type retaining ring) other than the C-type retaining ring 260. Moreover, the receptacle 30 may comprise a fixing member other than the metal ring. However, considering its small size in the X-direction, it is preferred to comprise the metal ring rather than the other fixing member. In addition, considering a capability as a fixing member, it is preferred to comprise the C-type retaining ring 260 rather than the E-type retaining ring or the like.

Figure 6:
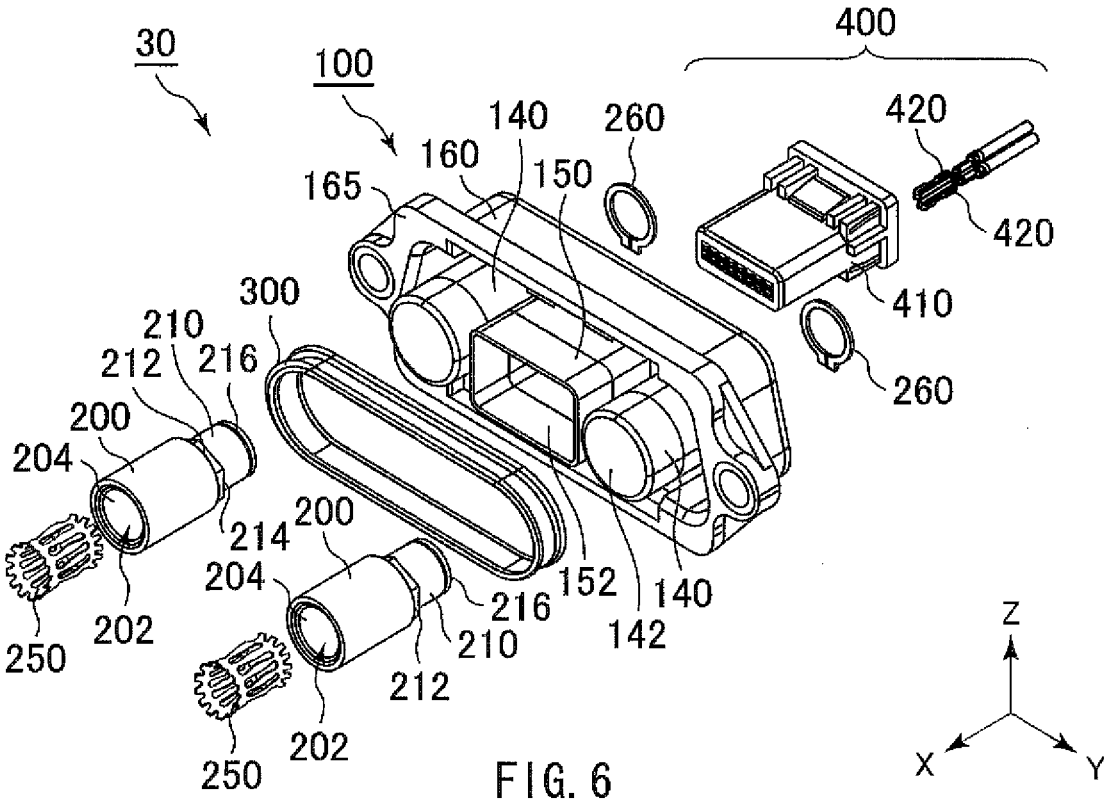
FIG. 6 is an exploded, perspective view showing the receptacle of FIG. 5.
Figure 7:
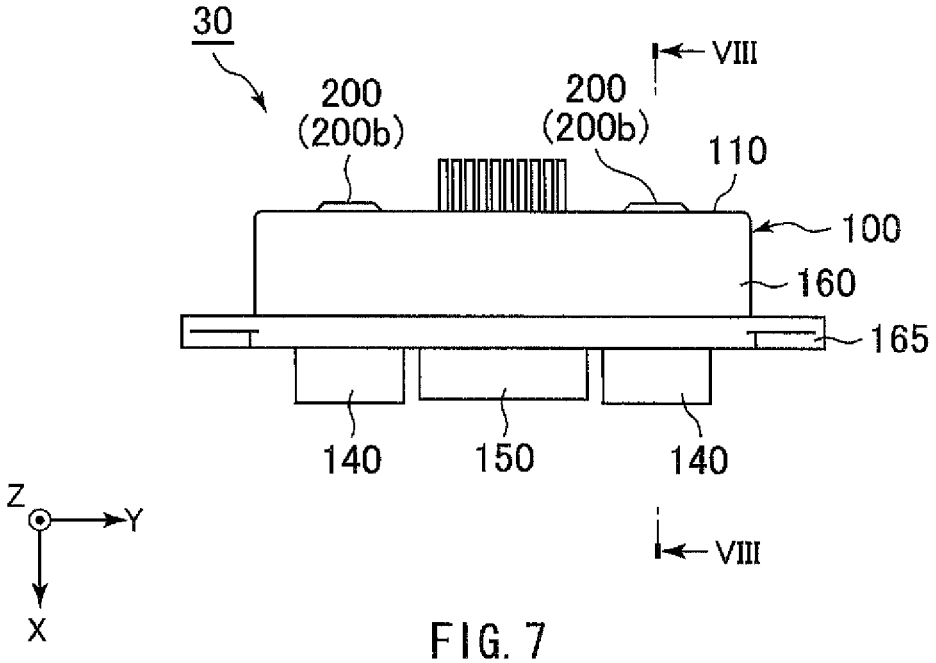
FIG. 7 is a top view showing the receptacle of FIG. 5.
Figure 8:
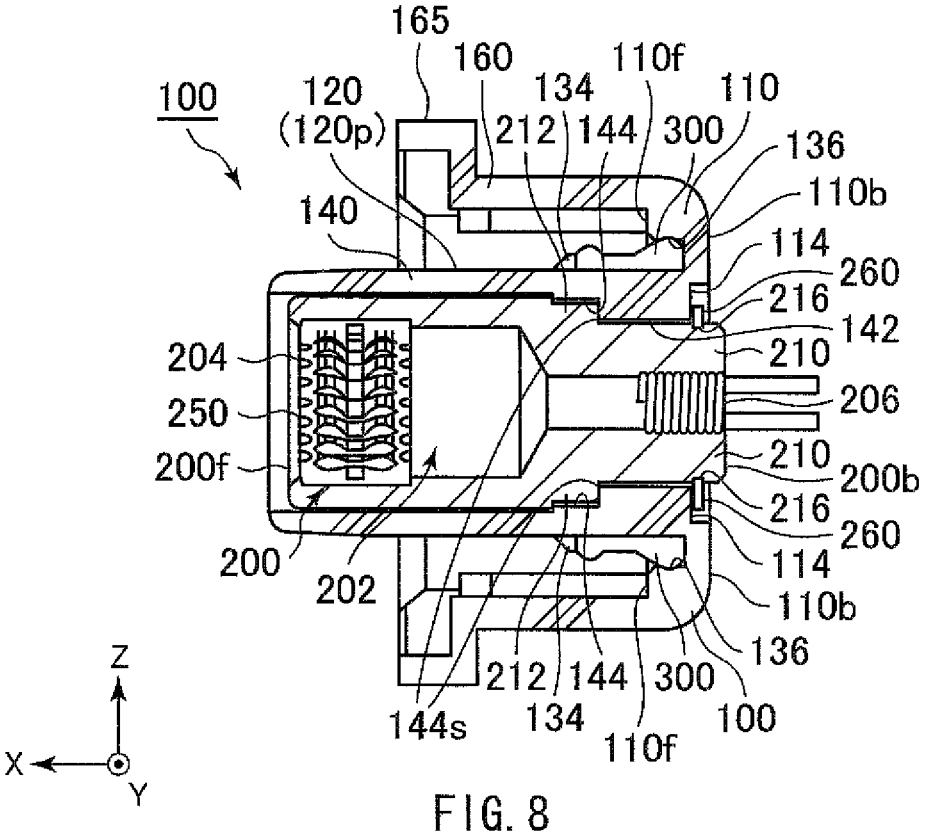
FIG. 8 is a cross-sectional view showing the receptacle of FIG. 7, taken along line VIII-VIII.
Figure 9:
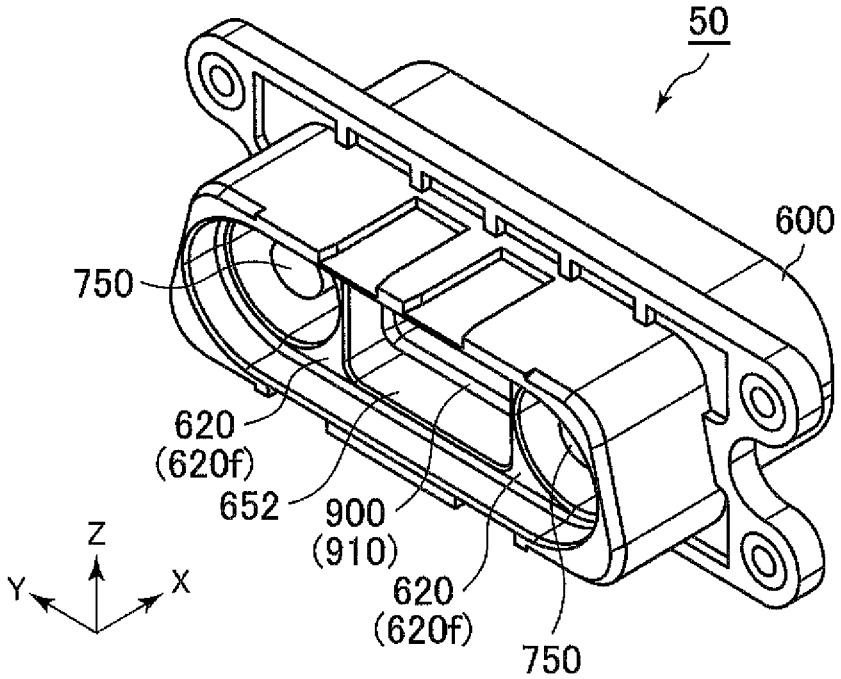
FIG. 9 is a perspective view showing a plug which constitutes one of the connectors of the connector combination of FIG. 2.

As can be seen from FIGS. 6 to 8, the housing 100 has a rear wall 110, an enclosed portion 120, two contact-enclosures 140, an intermediary-connector enclosure 150, an enclosure 160 and a flange 165, wherein the enclosed portion 120 extends forward from the rear wall 110, the contact-enclosures 140 further extend forward from the enclosed portion 120, the intermediary-connector enclosure 150 is located between the two contact-enclosures 140, the enclosure 160 extends forward from the rear wall 110, and the flange 165 is formed on a front end of the enclosure 160. The flange 165 is used when the receptacle 30 is attached to the module box 20.

As can be seen from FIGS. 6 and 8, the rear wall 110 is formed with two contact-holding holes 142 and one intermediary-connector holding hole 152. Each of the contact-holding holes 142 and the intermediary-connector holding hole 152 pierces the rear wall 110 along the front-rear direction. The contact-holding hole 142 is located within the contact-enclosure 140 in the YZ-plane. The intermediary-connector holding hole 152 is located within the intermediary-connector enclosure 150 in the YZ-plane.

As shown in FIG. 8, the front of the contact-holding hole 142 is provided with an abutment portion 144. In other words, the abutment portion 144 is located toward the mating side with respect to the contact-holding hole 142. The illustrated abutment portion 144 is a hole having a regular hexagonal column-like shape, wherein the abutment portion 144 is recessed rearward. An external diameter of the abutment portion 144 is larger than an external diameter of the contact-holding hole 142 in the YZ-plane so that a boundary between the abutment portion 144 and the contact-holding hole 142 is formed with a surface (an abutment surface 144*s*) which faces forward.

As shown in FIG. 8, the rear of the contact-holding hole 142 is provided with a recess 114 which is formed so as to surround the contact-holding hole 142. In other words, the recess 114 is located around the contact-holding hole 142. A rear surface 110*b* of the rear wall 110 is recessed forward so that the recess 114 according to the present embodiment is formed. The recess 114 is used as a space for handling a tool when an attaching work of the C-type retaining ring 260 is carried out. The recess 114 is provided at a position (according to the present embodiment, on the rear surface 110*b* of the rear wall 110) which allows the work to be easily carried out so that a size of the recess 114 is reducible to a necessity minimum size.

As shown in FIG. 8, a periphery 120*p* of the enclosed portion 120 is provided with a plurality of seal stoppers 134 each of which protrudes in a direction (a direction directed toward the enclosure 160) perpendicular to the X-direction. The rear wall 110 is formed with ditches 136 which are recessed rearward from the front surface 110*f*. The sealing member 300 is attached to the periphery 120*p* of the enclosed portion 120 so as to be sandwiched between the seal stoppers 134 and the ditches 136 in the X-direction. Accordingly, a movement of the sealing member 300 in the X-direction is regulated.

As can be seen from FIG. 8, the enclosure 160 encloses the enclosed portion 120 and the seal stoppers 134 in the YZ-plane. The flange 165, which is the front end of the enclosure 160, is located rearward of the contact-enclosures 140 and the intermediary-connector enclosure 150. In other words, as shown in FIG. 7, the contact-enclosures 140 and the intermediary-connector enclosure 150 protrude forward beyond the enclosure 160. Moreover, the contact-enclosures 140 protrude forward beyond the intermediary-connector enclosure 150.

Referring to FIGS. 6 and 8, the power contact 200 has a cylindrical shape. The power contact 200 is formed with a contact receiver 202 and a screw hole 206, wherein the contact receiver 202 is configured to receive the power contact 700 (the plug power contact) of the mating connector or the plug 50 as described later, and the screw hole 206 extends forward from a rear end 200*b*. The screw hole 206 is used for connection to a bus bar (not shown). The contact receiver 202 is a through hole leading to the screw hole 206 from a front end 200*f*. The contact receiver 202 has a front end which is provided with an attached portion 204, wherein the attached portion 204 is attached with the spring 250. The contact receiver 202 and the screw hole 206 pierce the power contact 200 from the front end 200*f* to the rear end 200*b* so that it is possible to reduce a plating failure caused in a plating process of the power contact 200. For example, when a low current capacity works sufficiently, the power contact 200 may have a light weight by lengthening a spot facing depth of the contact receiver 202.

The power contact 200 has a held portion 210 held in the contact-holding hole 142, an abutting portion 212 provided in front of the held portion 210, and a fixed portion 216 formed behind the held portion 210.

The held portion 210 has a shape corresponding to the contact-holding hole 142. The held portion 210 is inserted into the contact-holding hole 142 from the front (i.e. according to the present embodiment, along the negative X-direction) so that the power contact 200 is held by the housing 100.

The abutting portion 212 is a portion which is brought into abutment with the abutment portion 144 when the held portion 210 is inserted into the contact-holding hole 142. The abutting portion 212 has an angular column-like shape which has an external diameter larger than the held portion 210 in the YZ-plane. The external diameter of the abutting portion 212 is smaller than an external diameter of the contact receiver 202 in the YZ-plane. The abutting portion 212 according to the present embodiment has a hexagonal column-like shape corresponding to the abutment portion 144 so as to be received in the abutment portion 144. The shape of the abutting portion 212 corresponds to the shape of the abutment portion 144 so that the power contact 200 is unrotatable under a state where the abutting portion 212 is received in the abutment portion 144.

The fixed portion 216 is a ditch recessed toward the center of the power contact 200 in a radius direction. The ditch, which constitutes the fixed portion 216, has two side surfaces facing each other in the X-direction (i.e. front to rear). The front side surface of the ditch is flush with a front surface of the recess 114 under a state where the abutting portion 212 is brought into abutment with the abutment portion 144. Moreover, a width (a length in the X-direction) of the ditch, which constitutes the fixed portion 216, corresponds to a thickness of the C-type retaining ring 260. The C-type retaining ring 260 is attached to the fixed portion 216 under the state where the abutting portion 212 is brought into abutment with the abutment portion 144 so that the abutting portion 212 and the C-type retaining ring 260 sandwich a part of the housing 100. In other words, the part of the housing 100 is sandwiched between the abutting portion 212 and the C-type retaining ring 260 so that the power contact 200 is fixed to and held by the housing 100.

The power contact 200, except the fixed portion 216 and the rear end 200*b*, is covered by the contact-enclosure 140 under a state where the held portion 210 is inserted in and held by the contact-holding hole 142. As can be seen from FIG. 6, the abutting portion 212 of each of the two power contacts 200 has six (i.e. a plurality of) side surfaces including one facing surface 214. The facing surfaces 214 of the two power contacts 200 are side surfaces which located at positions closest to each other in the Y-direction (lateral direction). The two power contacts 200 are arranged so that the facing surfaces 214 are in parallel to each other and each of the facing surfaces 214 is perpendicular to the Y-direction (see the power contacts 700 of FIG. 12). In other words, the abutting portions 212 of the power contacts 200 have the facing surfaces 214 which are located at positions closest to each other in the Y-direction and face each other. According to the present embodiment, because the facing surfaces 214 are arranged in parallel (i.e. the abutment portions 144 are arranged in a manner where the two facing surfaces 214 extend in parallel to each other), no part has extremely thin thickness even though the housing 100 is formed with the intermediary-connector holding hole 152. Thus, a strength of the housing 100 is maintained.

As shown in FIG. 6, the intermediary connector 400 has a square tube-like shape. The intermediary connector 400 comprises an intermediary housing 410 and signal contacts 420 which are connected to a cable and held by the intermediary housing 410. The signal contact 420 according to the present embodiment is a socket contact. As can be seen from FIGS. 5 to 7, the intermediary connector 400 is inserted in the intermediary-connector holding hole 152 from the rear surface 110*b* of the rear wall 110 of the housing 100 so that the intermediary connector 400 is attachably/detachably held in the intermediary-connector holding hole 152. The intermediary connector 400 is held by the housing 100 so as to be located between the two power contacts 200 in the Y-direction. The intermediary-connector enclosure 150 is provided so as to have a gap at least between a front end thereof and the intermediary connector 400 (the intermediary housing 410) under a state where the intermediary connector 400 is held by the housing 100.

As shown in FIGS. 9 to 13, the plug 50 according to the present embodiment comprises a housing 600 made of an insulating material, two of the power contacts (plug power contacts) 700 each made of a metal, two insulation caps 750 each made of an insulating material, C-type retaining rings (fixing members) 760 each made of a metal, and an intermediary connector (intermediary-connector-for-plug) 900. Similar to the receptacle 30, the plug 50 may comprise a metal ring (for example, an E-type retaining ring) other than the C-type retaining ring 760 or comprise another fixing member.

As shown in FIGS. 9 to 13, the housing 600 has a rear wall 610 and a guard portion 660 which extends forward from a front surface 610*f* of the rear wall 610. The guard portion 660 has a middle part formed with a flange 665 which protrudes outward in the YZ-plane. The flange 665 is used when the plug 50 is fixed to the panel 40 (see FIG. 1).

As can be seen from FIGS. 9, 10, 12 and 13, the housing 600 is formed with two contact accommodating portions 640, two contact-holding holes 642 and an intermediary-connector holding hole 652, wherein the contact accommodating portions 640 are provided in the guard portion 660, the contact-holding holes 642 pierce the rear wall 610 in the X-direction, and the intermediary-connector holding hole 652 pierces the guard portion 660 and the rear wall 610. The contact accommodating portion 640 has an external diameter larger than the contact-holding hole 642.

Figure 12:
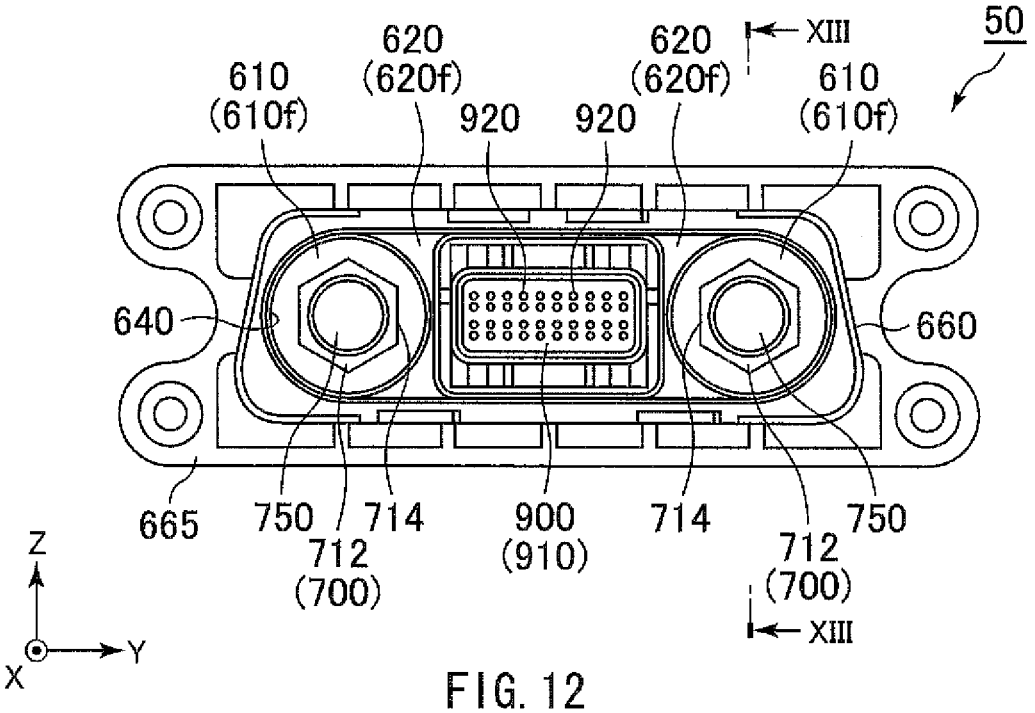
FIG. 12 is a front view showing the plug of FIG. 9.
Figure 13:
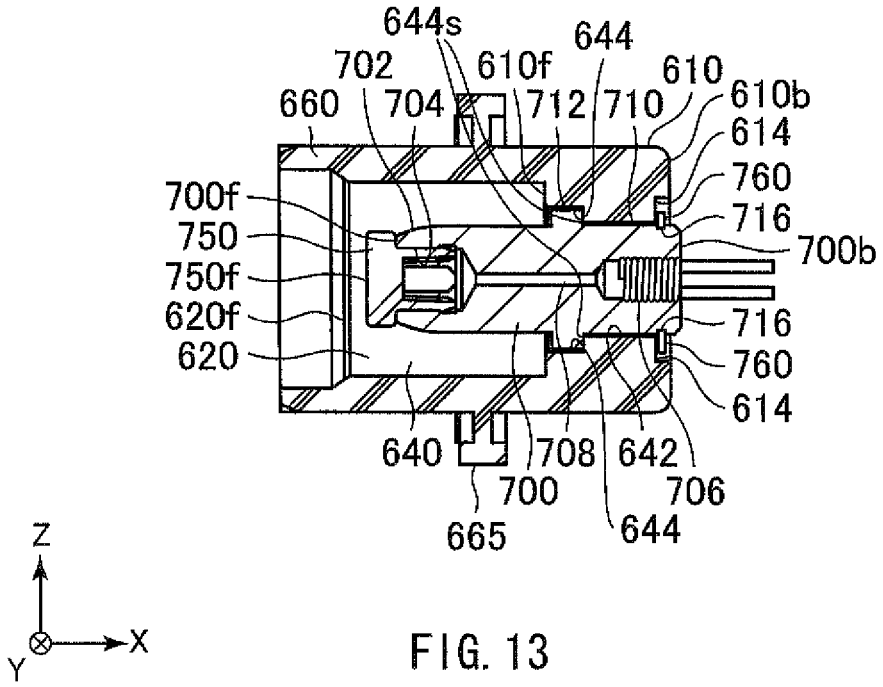
FIG. 13 is a cross-sectional view showing the plug of FIG. 12, taken along line XIII-XIII.

As can be seen from FIGS. 12 and 13, the front of the contact-holding hole 642 is provided with an abutment portion 644. In other words, the abutment portion 644 is located toward the mating side with respect to the contact-holding hole 642. The abutment portion 644 according to the present embodiment is located between the contact-holding hole 642 and the contact accommodating portion 640 in the X-direction. The contact accommodating portion 640 and the contact-holding hole 642 pierce the housing 600 in the X-direction together with the abutment portion 644. The illustrated abutment portion 644 is a hole having a regular hexagonal column-like shape, wherein the abutment portion 644 is recessed rearward. An external diameter of the abutment portion 644 is larger than an external diameter of the contact-holding hole 642 in the YZ-plane so that a boundary between the abutment portion 644 and the contact-holding hole 642 is formed with a surface (an abutment surface 644*s*) which faces forward. Moreover, the external diameter of the abutment portion 644 is smaller than an external diameter of the contact accommodating portion 640 in the YZ-plane so that the shape of the abutment portion 644 is visible when seen from a front end of the housing 600.

As shown in FIG. 13, the rear of the contact-holding hole 642 is provided with a recess 614 which is formed so as to surround the contact-holding hole 642. In other words, the recess 614 is located around the contact-holding hole 642. A rear surface 610*b* of the rear wall 610 is recessed forward so that the recess 614 according to the present embodiment is formed. Similar to the recess 114 in relation to the C-type retaining ring 260, the recess 614 is used as a space for handling a tool when an attaching work of the C-type retaining ring 760 is carried out.

Figure 10:
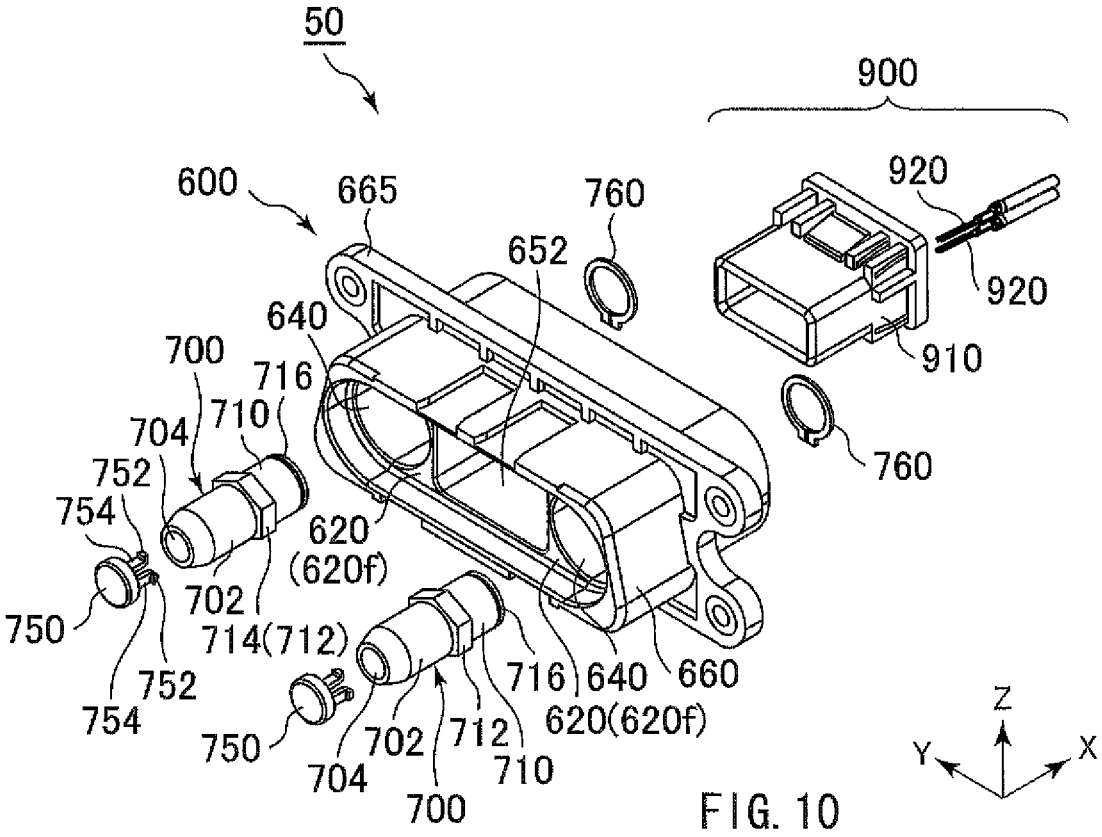
FIG. 10 is an exploded, perspective view showing the plug of FIG. 9.
Figure 11:
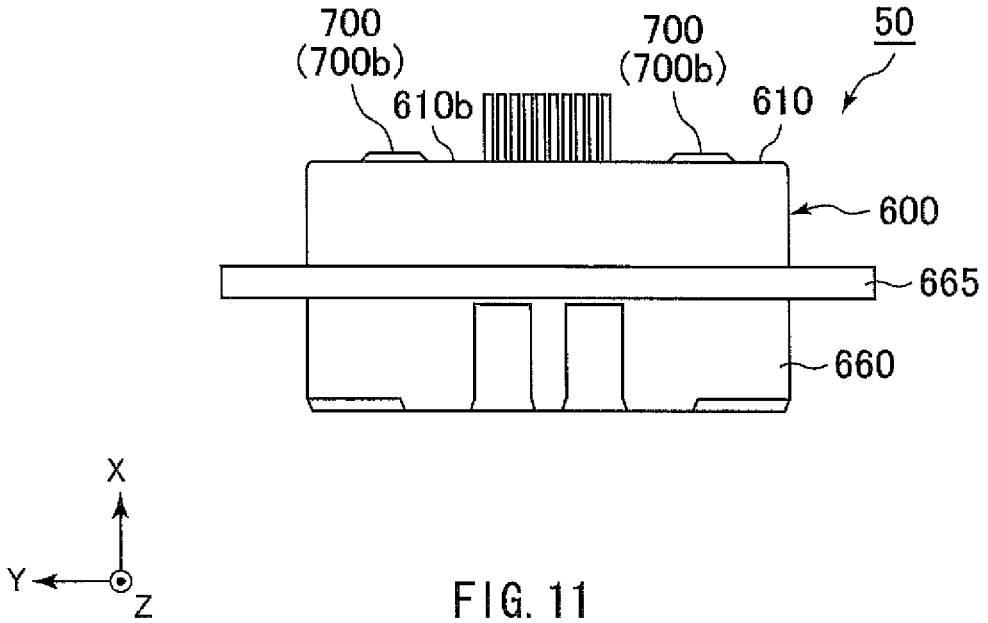
FIG. 11 is a top view showing the plug of FIG. 9.

As shown in FIGS. 10, 12 and 13, electric shock preventers 620 are provided between the contact accommodating portion 640 and the intermediary-connector holding hole 652. The electric shock preventer 620 according to the present embodiment is a sidewall of the intermediary-connector holding hole 652 (i.e. a part of the housing 600). The electric shock preventer 620 lowers a possibility that a finger is entered in the contact accommodating portion 640.

Referring to FIGS. 10, 12 and 13, the power contact 700 has a bullet-like shape. The power contact 700 is formed with an attached hole 704, a screw hole 706, and a communicating hole 708, wherein the attached hole 704 extends rearward from a front end 700*f* so as to be depressed, the screw hole 706 extends forward from a rear end 700*b*, and the communicating hole 708 communicates with the attached hole 704 and the screw hole 706. The screw hole 706 is used for connection to a bus bar (not shown).

Figure 14:
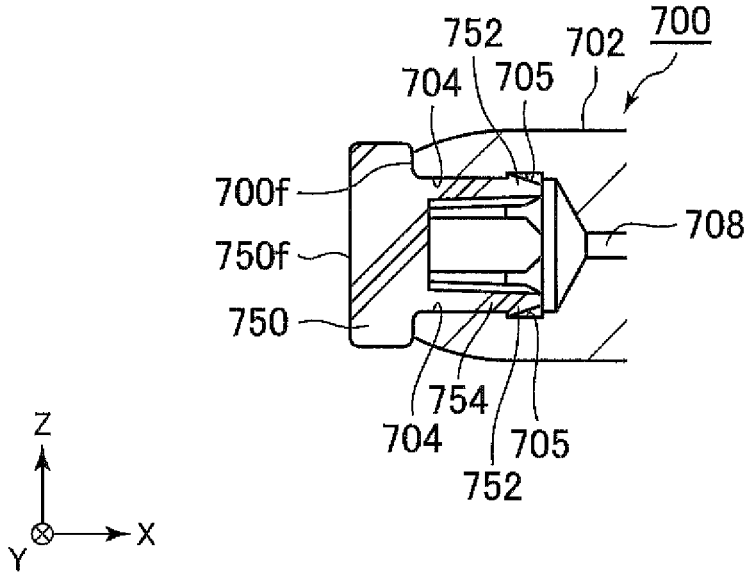
FIG. 14 is an enlarged, cross-sectional view showing an insulation cap of the plug of FIG. 13 and the vicinity of the insulation cap.

The attached hole 704 and the communicating hole 708 constitute a through hole leading to the screw hole 706 from a front end 700*f*. The attached hole 704, the communicating hole 708 and the screw hole 706 pierce the power contact 700 from the front end 700*f* to the rear end 700*b* so that it is possible to reduce a plating failure caused in a plating process of the power contact 700. For example, when a low current capacity works sufficiently, the power contact 700 may have a light weight by enlarging the communicating hole 708. As shown in FIG. 14, the attached hole 704 has an inside surface which is formed with a locked portion (lock ditch) 705 recessed outward in a radius direction.

As best shown in FIG. 13, the power contact 700 has a received portion 702, an abutting portion 712, a held portion 710 and a fixed portion 716, wherein the received portion 702 is configured to be received in the contact receiver 202 of the power contact (receptacle power contact) 200 (i.e. the mating contact) of the receptacle 30, the abutting portion 712 is provided behind the received portion 702, the held portion 710 is provided behind the abutting portion 712, and the fixed portion 716 is provided behind the held portion 710.

The held portion 710 is a portion held by the contact-holding hole 642. The held portion 710 is inserted into the contact-holding hole 642 from the front (i.e. according to the present embodiment, along the positive X-direction) so that the power contact 700 is held by the housing 600.

The abutting portion 712 is a portion which is brought into abutment with the abutment portion 644 when the held portion 710 is inserted into the contact-holding hole 642. The abutting portion 712 has a tangular column-like shape which has an external diameter larger than the held portion 710 in the YZ-plane. The abutting portion 712 according to the present embodiment has a hexagonal column-like shape corresponding to the abutment portion 644 so as to be received in the abutment portion 644. The shape of the abutting portion 712 corresponds to the shape of the abutment portion 644 so that the power contact 700 is unrotatable under a state where the abutting portion 712 is received in the abutment portion 644. The abutting portion 712 has the external diameter larger than the received portion 702 in the YZ-plane so that the abutting portion 712 is visible through the contact accommodating portion 640 when the plug 50 is seen from the front thereof.

As best shown in FIG. 12, the abutting portion 712 of each of the two power contacts 700 has six (i.e. a plurality of) side surfaces including one facing surface 714. The facing surfaces 714 of the two power contacts 700 are side surfaces which located at positions closest to each other in the Y-direction (lateral direction). The two power contacts 700 are arranged so that the facing surfaces 714 are in parallel to each other and each of the facing surfaces 714 is perpendicular to the Y-direction. In other words, the abutting portions 712 of the power contacts 700 have the facing surfaces 714 which are located at positions closest to each other in the Y-direction and face each other. According to the present embodiment, because the facing surfaces 714 are arranged in parallel (i.e. the abutment portions 644 are arranged in a manner where the two facing surfaces 714 extend in parallel to each other), no part has extremely thin thickness even though the housing 600 is formed with the intermediary-connector holding hole 652. Thus, a strength of the housing 600 is maintained.

As shown in FIG. 13, the fixed portion 716 is a ditch recessed toward the center of the power contact 700 in the radius direction. The ditch, which constitutes the fixed portion 716, has two side surfaces facing each other in the X-direction (i.e. front to rear). The front side surface of the ditch is flush with a front surface of the recess 614 under a state where the abutting portion 712 is brought into abutment with the abutment portion 644. Moreover, a width (a length in the X-direction) of the ditch, which constitutes the fixed portion 716, corresponds to a thickness of the C-type retaining ring 760. The C-type retaining ring 760 is attached to the fixed portion 716 under the state where the abutting portion 712 is brought into abutment with the abutment portion 644 so that the abutting portion 712 and the C-type retaining ring 760 sandwich a part of the housing 600. In other words, the part of the housing 600 is sandwiched between the abutting portion 712 and the C-type retaining ring 760 so that the power contact 700 is fixed to and held by the housing 600.

As shown in FIG. 13, under a held state where the power contact 700 is held by the housing 600, the electric shock preventer 620 is located lateral to the power contact 700. Under the held state, the front end 700*f* of the power contact 700 is located within the contact accommodating portion 640. Thus, the front end 700*f* of the power contact 700 is located rearward of a front end 6201 of the electric shock preventer 620. In other words, the front end 620*f* of the electric shock preventer 620 protrudes forward beyond the front end 700*f* of the power contact 700. As can be seen from the above description, the plug 50 has a structure preventable an electric shock.

According to the present embodiment, in addition to the aforementioned structure, the insulation cap 750 is provided so as to prevent the electric shock. In detail, as shown in FIG. 14, the insulation cap 750 has a lock portion 752 protruding in a direction perpendicular to the X-direction, and a support portion 754 resiliently supporting the lock portion 752. When the insulation cap 750 is inserted into the attached hole 704 from the front end 700*f* of the power contact 700, the lock portion 752 locks the locked portion 705 so that the insulation cap 750 is attached to the front end 7001 the power contact 700. As shown in FIG. 13, under a state where the insulation cap 750 is attached to the front end 700*f* the power contact 700, the front end 750*f* of the insulation cap 750 according to the present embodiment is located within the contact accommodating portion 640. Thus, the front end 750*f* of the insulation cap 750 is located rearward of the front end 6201 of the electric shock preventer 620. In other words, the front end 620*f* of the electric shock preventer 620 protrudes forward beyond the front end 750*f* of the insulation cap 750. As can be seen from the above description, the plug 50 has a structure further preventable the electric shock as compared with each of cases where the plug 50 does not have the insulation cap 750 and where the insulation cap 750 protrudes forward beyond the electric shock preventer 620.

Figure 4:
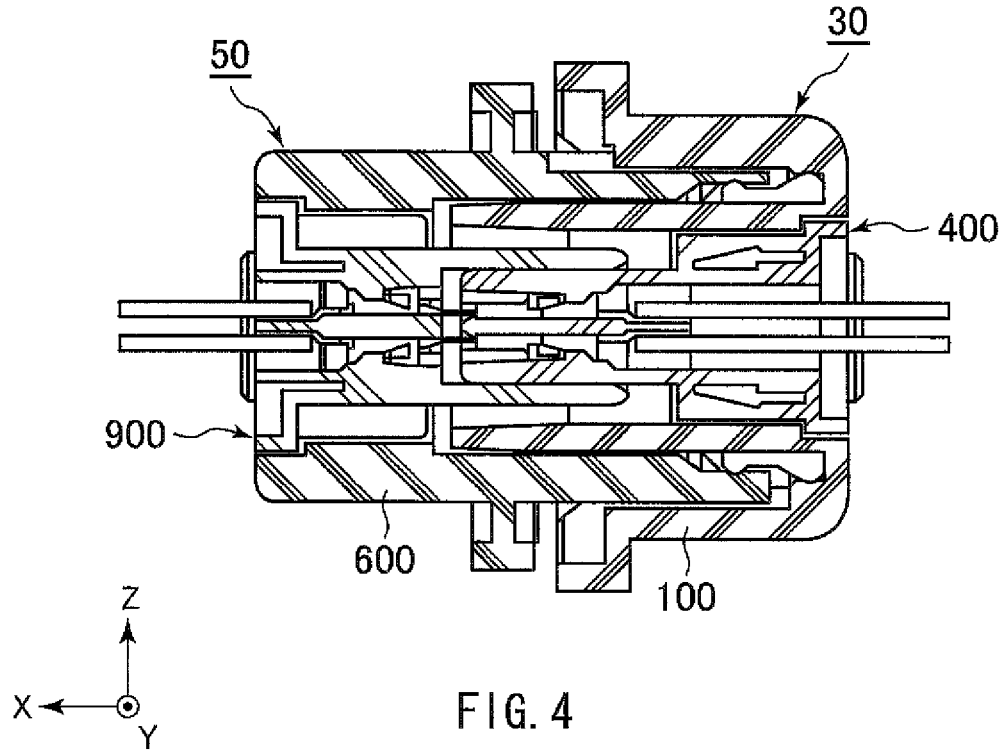
FIG. 4 is a cross-sectional view showing a signal contact of the connector combination of FIG. 2 and the vicinity of the signal contact.
Figure 5:
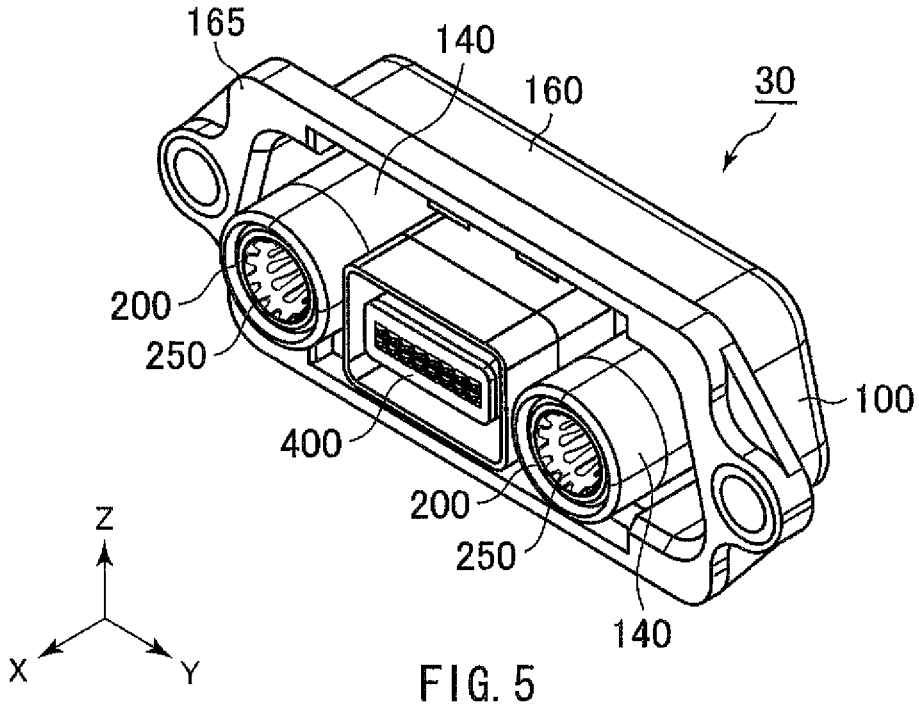
FIG. 5 is a perspective view showing a receptacle which constitutes one of connectors of the connector combination of FIG. 2.

As shown in FIG. 10, the intermediary connector 900 comprises an intermediary housing 910 and signal contacts 920 which are connected to a cable and held by the intermediary housing 910. As shown in FIG. 4, the intermediary connector 900 is connected to the intermediary connector 400 when the plug 50 and the receptacle 30 are mated with each other. As can be seen from FIGS. 4, 6 and 10, the signal contact 920 according to the present embodiment is a pin contact configured to be inserted in and connected to the socket contact or the signal contact 420. As can be seen from FIGS. 9 to 13, the intermediary connector 900 is inserted into the intermediary-connector holding hole 652 from the rear surface 610*b* of the rear wall 610 of the housing 600. The intermediary connector 900 is attachably/detachably held by the housing 600 so as to be located between the two power contacts 700 in the Y-direction.

According to the aforementioned embodiment, the C-type retaining ring 260 or the fixing member is attached from behind the housing 100 of the receptacle 30. Similarly, the C-type retaining ring 760 or the fixing member is attached from behind the housing 600 of the plug 50. Accordingly, the working space for handling the tool may be minimized. Moreover, each of the housings 100 and 600 has a front side which is not formed with unnecessary space so that each of the receptacle 30 and the plug 50 has a superior structure from a viewpoint of preventing the electric shock.

Each of the abutting portions 212 and 712 is shaped in a noncylindrical shape (for example, an angular column-like shape) while the abutment portions 144 and 644 are shaped to correspond to the shapes of the abutting portions 212 and 712, respectively. Accordingly, for example, when each of the power contact 200 and 700 is attached to a bus bar (not shown), each of the power contact 200 and 700 is prevented from unintentionally rotating.

According to the aforementioned embodiment, the abutting portion 212 of the power contact 200 has a regular hexagonal column-like shape, however, the present invention is not limited to this embodiment. It is sufficient that the abutting portion 212 is formed in a shape which is preventable the power contact 200 from rotating around its axis. For example, the shape of the abutting portion 212 may be an angular column-like shape such as a triangular column-like shape or a rectangular column-like shape, or another shape such as an annular column-like shape or an elliptic column-like shape. However, considering a strength and a size of the housing 100, it is preferred that the shape be an angular column-like shape having six or more side surfaces. If a prevention of rotating is realized by another method, it is sufficient that the abutting portion 212 is formed to be sandwichable the rear wall 110 while cooperating with the C-type retaining ring (fixing member) 260. However, it is preferred that the abutting portion 212 be formed similar to the present embodiment in order to reduce a size of the receptacle 30. The abutting portion 712 of the power contact 700 may be also modified similar to the abutting portion 212 of the power contact 200.

Figure 15:
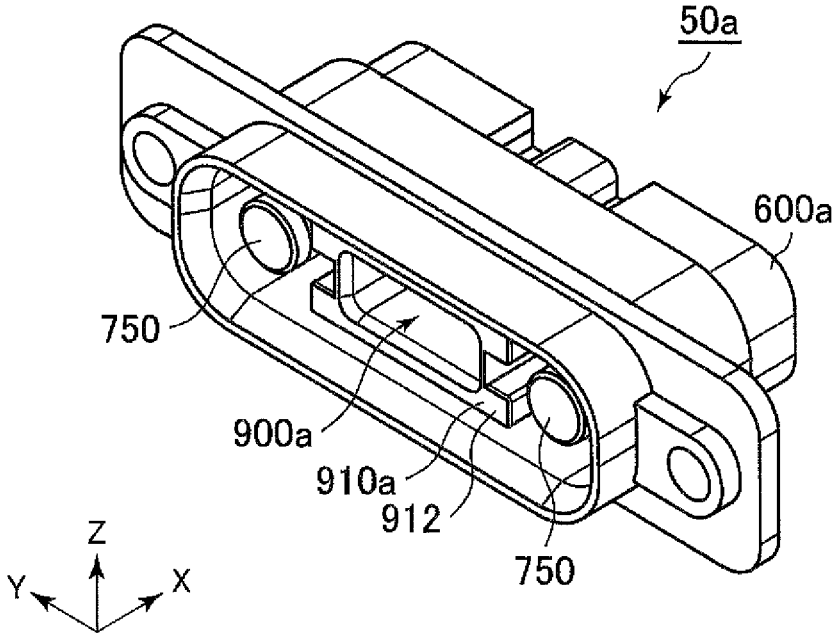
FIG. 15 is a perspective view showing a modification of the plug of FIG. 9.
Figure 16:
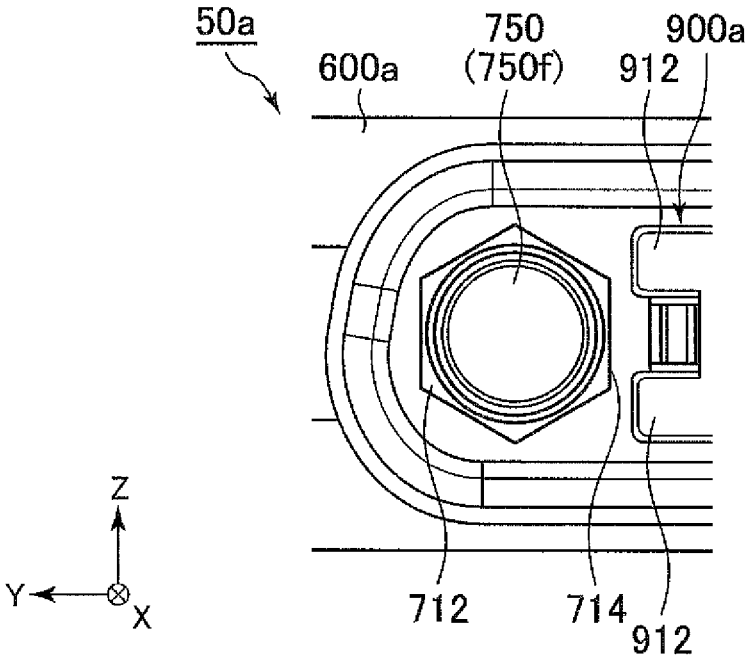
FIG. 16 is an enlarged, front view showing a power contact of the plug of FIG. 15 and the vicinity of the power contact.
Figure 17:
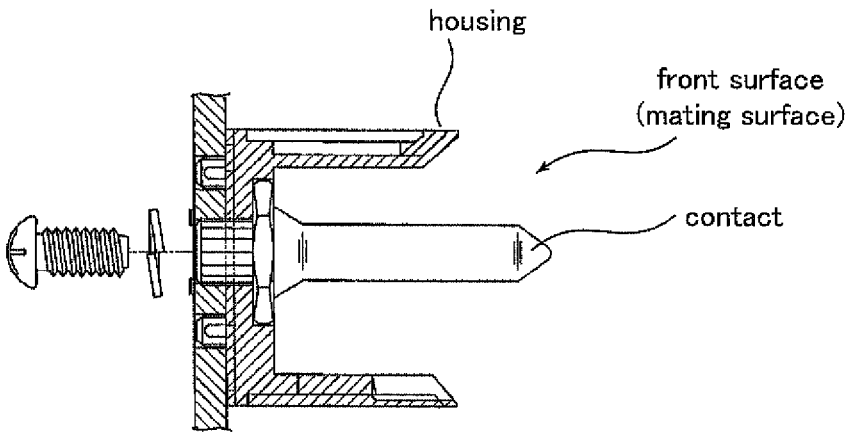
FIG. 17 is a cross-sectional view showing the connector of Patent Document 1.
Figure 18:
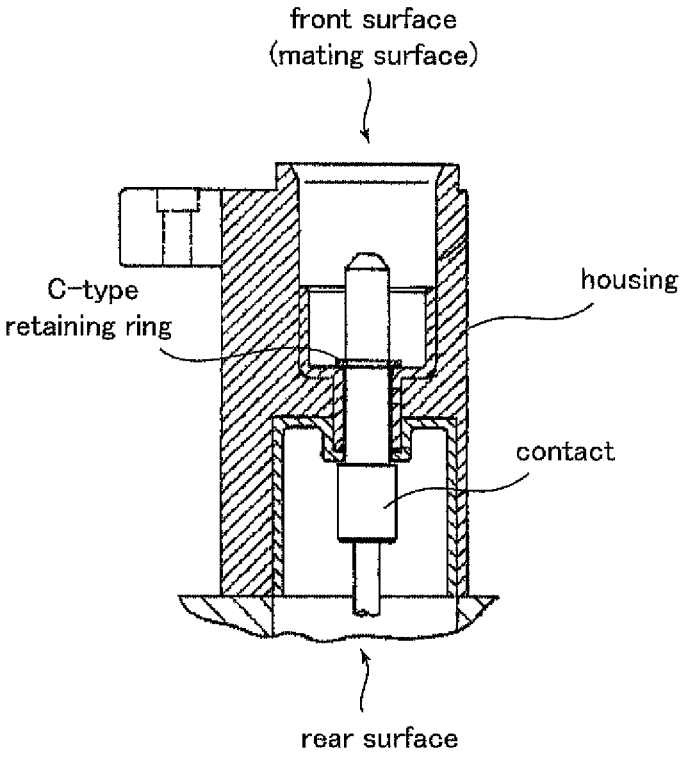
FIG. 18 is a cross-sectional view showing the connector of Patent Document 2.

The electric shock preventer 620 of the plug 50 may not be the sidewall of the intermediary-connector holding hole 652. For example, as shown in FIGS. 15 and 16, an electric shock preventer of a plug 50*a* may be formed, not as a part of a housing 600*a*, but as a part of an intermediary connector 900*a*. More specifically, the electric shock preventer of the plug 50*a* may be provided in an intermediary housing 910 of the intermediary connector 900*a*. The illustrated housing 600*a* has no inner partition wall located lateral to the intermediary connector 900*a*. Instead, the intermediary housing 910 has two protrusions 912 formed at a side portion thereof, wherein the protrusions 912 protrude toward the insulation cap 750 (i.e. power contact 700). The two protrusions 912 are provided so as to be apart from each other in the Z-direction, and serve as the electric shock preventer.

The present application is based on a Japanese patent application of JP2010-286497 filed before the Japan Patent Office on Dec. 22, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

1 storage battery module
10 storage battery
20 module box
30 receptacle (connector)
40 panel
50, 50*a* plug (connector)
100 housing
110 rear wall
110*f* front surface
110*b* rear surface
114 recess
120 enclosed portion
120*p* periphery
134 seal stopper
136 ditch
140 contact-enclosure
142 contact-holding hole
144 abutment portion
144*s* abutment surface
150 intermediary-connector enclosure
152 intermediary-connector holding hole
160 enclosure
165 flange
200 power contact (receptacle power contact)
200*f* front end

200*b* rear end
202 contact receiver
204 attached portion
206 screw hole
210 held portion
212 abutting portion
214 facing surface
216 fixed portion
250 spring
260 C-type retaining ring (fixing member)
300 sealing member
400 intermediary connector (intermediary-connector-for-receptacle)
410 intermediary housing
420 signal contact
600, 600*a* housing
610 rear wall
610*f* front surface
610*b* rear surface
614 recess
620 electric shock preventer
620*f* front end
640 contact accommodating portion
642 contact-holding hole
644 abutment portion
644*s* abutment surface
652 intermediary-connector holding hole
660 guard portion
665 flange
700 power contact (plug power contact)
700*f* front end
700*b* rear end
702 received portion
704 attached hole
705 locked portion
706 screw hole
708 communicating hole
710 held portion
712 abutting portion
714 facing surface
716 fixed portion
750 insulation cap
750*f* front end
752 lock portion
754 support portion
760 C-type retaining ring (fixing member)
900, 900*a* intermediary connector (intermediary-connector-for-plug)
910, 910*a* intermediary housing
912 protrusion
920 signal contact

The invention claimed is:

1. A connector mateable along a front-rear direction with a mating connector located at a mating side, the connector comprising:

a housing having a rear wall, a contact-holding hole and an abutment portion, the contact-holding hole piercing the rear wall in the front-rear direction, the abutment portion being located toward the mating side with respect to the contact-holding hole;

a power contact attached to the housing, the power contact having a held portion, a fixed portion and an abutting portion, the held portion being inserted into the contact-holding hole from the mating side to be held by the contact-holding hole, the fixed portion being formed to be located far from the mating side in the front-rear direction with respect to the held portion, the abutting portion being formed to be located toward the mating side with respect to the held portion so that the abutting portion is brought into abutment with the abutment portion when the held portion is inserted in the contact-holding hole; and a fixing member fixing the power contact to the housing, the fixing member being attached to the fixed portion so that a part of the housing is sandwiched between the abutting portion and the fixing member in the front-rear direction.

2. The connector as recited in claim 1, wherein:

the abutting portion has an angular column-like shape which has an external diameter larger than the held portion in a plane perpendicular to the front-rear direction;

the abutment portion is recessed toward a side opposite to the mating side so as to have a shape corresponding to the shape of the abutting portion; and the abutting portion is held by the abutment portion so as to be unrotatable.

3. The connector as recited in claim 2, wherein the abutting portion has the angular column-like shape which has six or more side surfaces.

4. The connector as recited in claim 3, wherein the fixing member is a metal ring attached to the held portion.

5. The connector as recited in claim 4, wherein:

the housing has a recess formed on a rear surface of the rear wall thereof, the recess being recessed toward the mating side, the recess being located around the contact-holding hole; and the fixing member is attached to the fixed portion located in the recess.

6. The connector as recited in claim 1, wherein:

the power contact has a contact receiver configured to receive a plug power contact which is a mating contact; and an external diameter of the contact receiver is larger than an external diameter of the abutting portion in a plane perpendicular to the front-rear direction.

7. The connector as recited in claim 6, the connector comprising two of the power contacts, wherein:

the abutting portion of each of the power contacts has a facing surface, the facing surfaces being located at positions closest to each other in a lateral direction perpendicular to the front-rear direction, the facing surfaces facing each other; and the power contacts are arranged so that the facing surfaces are in parallel to each other and are perpendicular to the lateral direction.

8. The connector as recited in claim 7, the connector further comprising an intermediary connector which has a square tube-like shape, wherein the intermediary connector is held by the housing so as to be located between the power contacts in the lateral direction.

9. The connector as recited in claim 1, wherein:

the power contact has a received portion configured to be received in a receptacle power contact which is a mating contact; and an external diameter of the abutting portion is larger than an external diameter of the received portion in a plane perpendicular to the front-rear direction.

10. The connector as recited in claim 9, the connector comprising an electric shock preventer located at a side of the power contact, wherein a front end of the electric shock preventer protrudes toward the mating side beyond a front end of the power contact.

11. The connector as recited in claim 10, wherein:

the front end of the power contact is attached with an insulation cap; and the front end of the electric shock preventer protrudes toward the mating side beyond a front end of the insulation cap.

12. The connector as recited in claim 11, wherein:

the power contact is formed with an attached hole which extends from a front end thereof toward a side opposite to the mating side;

the attached hole has an inside surface which is formed with a locked portion; and the insulation cap has a lock portion which locks the locked portion, and a support portion which resiliently supports the lock portion.

13. The connector as recited in claim 10, the connector comprising two of the power contacts, wherein:

the abutting portion of each of the power contacts has a facing surface, the facing surfaces being located at positions closest to each other in a lateral direction perpendicular to the front-rear direction, the facing surfaces fading each other; and the power contacts are arranged so that the facing surfaces are in parallel to each other and are perpendicular to the lateral direction.

14. The connector as recited in claim 13, the connector further comprising an intermediary connector held by the housing, wherein the intermediary connector is held by the housing so as to be located between the power contacts in the lateral direction.

15. The connector as recited in claim 14, wherein the electric shock preventer is formed as a part of the intermediary connector.

16. The connector as recited in claim 15, wherein the intermediary connector has two protrusions provided at a side thereof, the protrusions protruding toward the power contact.

17. The connector as recited in claim 10, wherein the electric shock preventer is formed as a part of the housing.

18. The connector as recited in claim 1, wherein the power contact is formed with a screw hole extending from a rear end thereof toward the mating side.

19. The connector as recited in claim 18, wherein the power contact is formed with a through hole leading to the screw hole from a front end thereof.

* * * * *